US012312937B2

(12) United States Patent
Safonov et al.

(10) Patent No.: US 12,312,937 B2
(45) Date of Patent: May 27, 2025

(54) METHODS FOR MONITORING SOLIDS CONTENT DURING DRILLING OPERATIONS

(71) Applicant: Saudi Arabian Oil Company, Dhahran (SA)

(72) Inventors: Sergey Safonov, Moscow (RU); Dmitry Kovalev, Moscow (RU); Arturo Magana-Mora, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 450 days.

(21) Appl. No.: 17/844,340

(22) Filed: Jun. 20, 2022

(65) Prior Publication Data

US 2023/0203934 A1 Jun. 29, 2023

Related U.S. Application Data

(63) Continuation of application No. PCT/RU2021/000620, filed on Dec. 29, 2021.

(51) Int. Cl.
*E21B 44/02* (2006.01)
*E21B 47/002* (2012.01)

(52) U.S. Cl.
CPC ..... *E21B 44/02* (2013.01); *E21B 47/002* (2020.05); *E21B 2200/20* (2020.05)

(58) Field of Classification Search
CPC .... E21B 21/065; E21B 2200/20; E21B 44/00; E21B 21/01; E21B 49/005
See application file for complete search history.

(56) References Cited

U.S. PATENT DOCUMENTS 9,908,148 B2 3/2018 Torrione
10,577,912 B2 3/2020 Torrione
(Continued)

FOREIGN PATENT DOCUMENTS

EA 009718 B1 2/2008
EA 014301 B1 10/2010
(Continued)

OTHER PUBLICATIONS

Busch et al., "Cuttings Transport Modeling—Part 1: Specification of Benchmark Parameters with a Norwegian Continental Shelf Perspective", Society of Petroleum Engineers, PSE-180007-MS, 32 pages, 2016.

(Continued)

*Primary Examiner* — Kipp C Wallace
(74) *Attorney, Agent, or Firm* — DINSMORE & SHOHL LLP

(57) ABSTRACT

A method for monitoring solids content during drilling operations may include collecting real-time cuttings image data at a surface outlet of a natural resource well, determining cuttings characteristics data based on the real-time cuttings image data, collecting real-time surface mud data, and determining real-time, one-dimensional downhole cuttings information based on a multi-dimensional computational fluid dynamics model. The cuttings characteristics data may include cuttings size distribution, cuttings volume, cuttings velocity, cuttings orientation, cuttings area, or combinations thereof. The real-time surface mud data may include inlet mud parameters, drilling operational parameters, well planning parameters, or combinations thereof. Determining real-time, one-dimensional downhole cuttings information may include converting the multi-dimensional computational fluid dynamics model into a one-dimensional continuous cuttings transport model and computing an inte- (Continued)

grated one-dimensional continuous cuttings transport model. Inputs to the integrated one-dimensional continuous cuttings transport model may include the cuttings characteristics data and the real-time surface mud data.

16 Claims, 3 Drawing Sheets

(56) References Cited

U.S. PATENT DOCUMENTS

| | | | | |
|---|---|---|---|---|
| 11,085,258 | B2 | 8/2021 | Hutchinson et al. | |
| 2014/0333754 | A1* | 11/2014 | Graves | E21B 47/002 348/85 |
| 2017/0058620 | A1 | 3/2017 | Torrione | |
| 2018/0210413 | A1 | 7/2018 | Frangos | |
| 2019/0145239 | A1 | 5/2019 | Yu et al. | |
| 2019/0323328 | A1* | 10/2019 | Rao | E21B 21/01 |
| 2019/0368287 | A1 | 12/2019 | Shekhar et al. | |
| 2021/0017847 | A1 | 1/2021 | Aragall et al. | |
| 2022/0381132 | A1* | 12/2022 | Badis | E21B 47/002 |

FOREIGN PATENT DOCUMENTS

| | | | |
|---|---|---|---|
| GB | 2512760 | A | 10/2014 |
| WO | 2020131006 | A1 | 6/2020 |

OTHER PUBLICATIONS

Frangos et al., "Uncertainty quantification for cuttings transport process monitoring while drilling by ensemble Kalman filtering", Journal of Process Control, vol. 53, pp. 46-56, 2017.

Zhang et al., "Modeling of Dynamic Cuttings Transportation during Drilling of Oil and Gas Wells by Combining 2D CFD and 1D Discretization Approach", Society of Petroleum Engineers Journal, 22 pages, Jan. 22, 2020.

Search Report and Written Opinion pertaining to Application No. PCT/RU2021/000620 dated Sep. 22, 2022.

* cited by examiner

METHODS FOR MONITORING SOLIDS CONTENT DURING DRILLING OPERATIONS

CROSS-REFERENCE TO RELATED APPLICATION

This application is filed as a continuation of PCT/RU2021/000620 filed on Dec. 29, 2021, the entire disclosure of which is hereby incorporated herein by reference.

FIELD

The present disclosure relates to drilling operations and, more specifically, to methods for monitoring drilling operations.

TECHNICAL BACKGROUND

Wellbores may be drilled into the ground to extract petroleum in the form of fluids and/or gases. During the drilling process, drilling fluid may be utilized to assist with the drilling of the wellbore. Also during the drilling process, a drilling bit mills rock and earth into drill cuttings at the bottom of the wellbore. Drilling fluids are normally circulated through the drill bit and utilized to carry drill cuttings away from the bit, up the wellbore, and to a surface outlet. Inefficient transport of drill cuttings during this process can lead to cuttings buildup around the bit and drill string. This can lead to a variety of negative downhole events, including but not limited to lower rate of penetration, excessive bit wear, and incidents in which the bit and drilling string become immovable in the wellbore.

BRIEF SUMMARY

Accordingly, it is desirable to monitor characteristics of drill cuttings transport to prevent negative downhole events. Conventional methods of monitoring include either manual visual analysis of cuttings received at the surface or correlations estimating drill cuttings transport. These correlations typically included cuttings slip velocity and a hole cleaning index. The problem with these methods is they are not always accurate, often responding to conditions already in the past and not accounting for complex wellbore fluid flow patterns in real-time. Such methods also usually result in two responses, higher flow rates and more viscous muds. Such responses are not always beneficial because thicker, higher flow rate muds are less efficient in cleaning bits, potentially resulting in a lower rate of penetration. Another method used includes modeling cuttings transport through a multi-dimensional fluid model. However, these models are usually complex and time-intensive to calculate, resulting in lag-time between the input of parameters and useful data that can be applied to prevent negative downhole events. Accordingly, a need exists for drill cuttings transport models that are both accurate and have a short calculation time.

Embodiments of the present disclosure are generally directed to methods of generating downhole cuttings information in real-time using an integrated one-dimensional continuous cuttings transport model. The method includes collecting real-time cuttings image data, determining cuttings characteristics data based on the real-time cuttings image data, collecting real-time surface mud data, and determining real-time downhole cuttings information based on a multi-dimensional computation fluid dynamics model by converting the multi-dimensional computational fluid dynamics model into a one dimensional continuous cuttings transport model and computing an integrated one-dimensional continuous cuttings transport model. In one or more embodiments, the method may result in quicker generation of downhole cuttings information because the multi-dimensional computational fluid dynamics model is reduced to the one-dimensional continuous cuttings transport model. Such data may be modeled in "real-time," which allows for quicker modification to drilling tactics. The method may result in more accurate real-time downhole cuttings information than some traditional one-dimensional models because the integrated one-dimensional continuous cuttings transport model is determined by using a data assimilation method on the one-dimensional continuous cuttings transport model.

In one embodiment of the present disclosure, a method for monitoring solids content during drilling operations may comprise collecting real-time cuttings image data at a surface outlet of a natural resource well, determining cuttings characteristics data based on the real-time cuttings image data, collecting real-time surface mud data, and determining real-time, one-dimensional downhole cuttings information based on a multi-dimensional computational fluid dynamics model. The cuttings characteristics data may comprise cuttings size distribution, cuttings volume, cuttings velocity, cuttings orientation, cuttings area, or combinations thereof. The real-time surface mud data may comprise inlet mud parameters, drilling operational parameters, well planning parameters, or combinations thereof. Determining real-time, one-dimensional downhole cuttings information may comprise converting the multi-dimensional computational fluid dynamics model into a one-dimensional continuous cuttings transport model and computing an integrated one-dimensional continuous cuttings transport model. Inputs to the integrated one-dimensional continuous cuttings transport model may comprise the cuttings characteristics data and the real-time surface mud data.

Additional features and advantages of the technology disclosed in this disclosure will be set forth in the detailed description which follows, and in part will be readily apparent to those skilled in the art from the description or recognized by practicing the technology as described in this disclosure, including the detailed description which follows, the claims, as well as the appended drawings.

BRIEF DESCRIPTION OF THE DRAWINGS

The following detailed description of specific embodiments of the present disclosure can be best understood when read in conjunction with the following drawings, where like structure is indicated with like reference numerals and in which.

Reference will now be made in greater detail to various embodiments, some embodiments of which are illustrated in the accompanying drawings. Whenever possible, the same reference numerals will be used throughout the drawings to refer to the same or similar parts.

DETAILED DESCRIPTION

One or more embodiments of the present disclosure are directed to methods of monitoring drill cuttings concentration in a natural resource well drilling operation in real-time. In one or more embodiments, data about drill cuttings is collected at a surface outlet of the well. Other data, including but not limited to inlet mud parameters, drilling operational parameters, and well planning parameters are also collected. The data is entered as inputs into a multi-dimensional computational fluid dynamics model and the multi-dimensional model is converted to a one-dimensional continuous cuttings transport model. An integrated one-dimensional continuous cuttings transport model is then be computed from the one-dimensional model. The outputs of the integrated one-dimensional continuous cuttings transport model may allow drill cuttings concentration to be calculated along the borehole in real-time at a faster speed than if the model was still multi-dimensional. The integration of the model may also allow it to be more accurate than the non-integrated model. This may allow drilling personnel to proactively respond in real-time and take measures to correct inefficient transport of drill cuttings.

It should be understood that any computing system suitable for modeling downhole conditions may be used in the methods described herein. Such computing systems may include a processor and memory, where the processor may execute instructions from the memory. Inputs and outputs of the computing system may be operable to receive and output data relevant to the disclosed methods.

Figure 1:
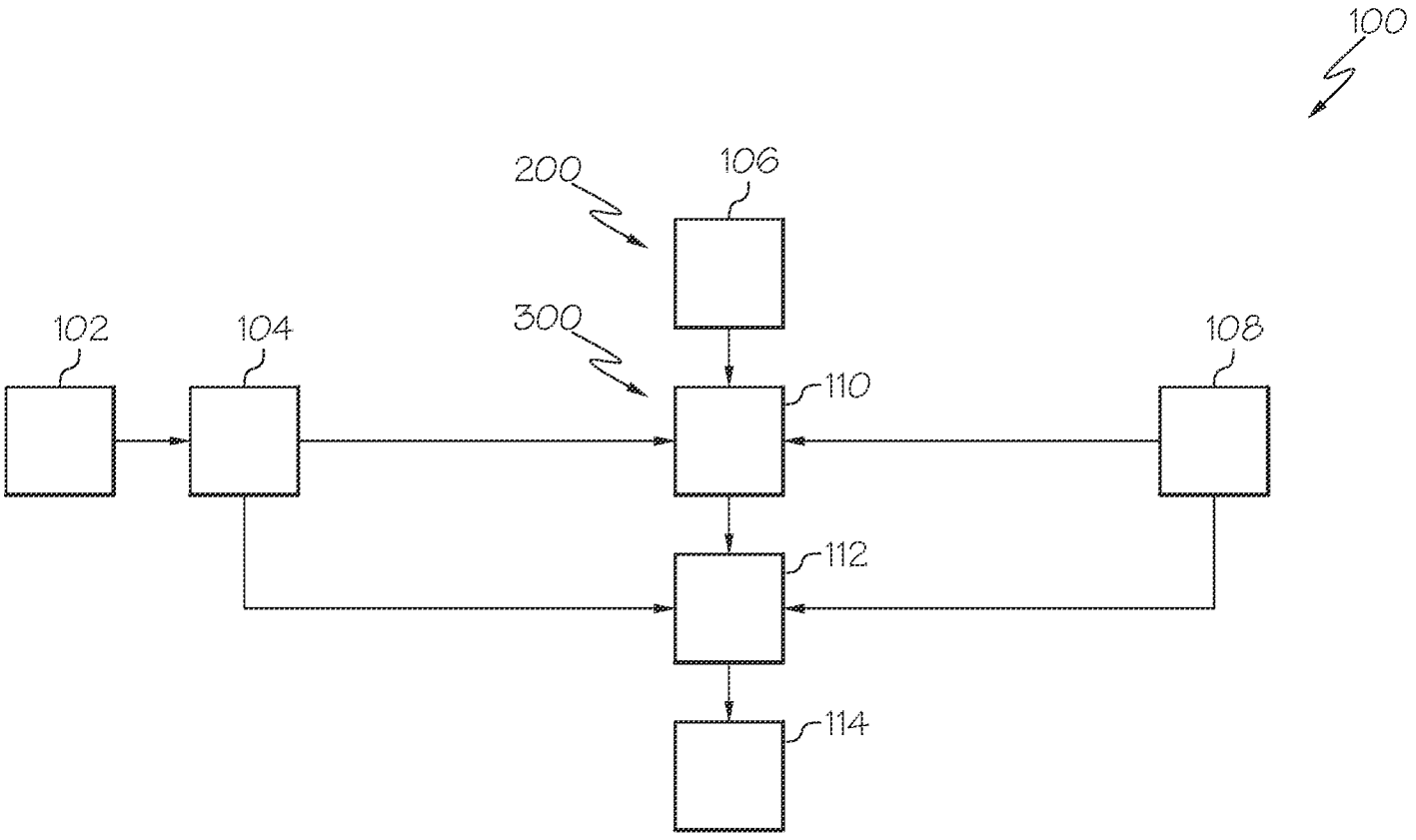
FIG. 1 depicts a process of a method of monitoring solids content during drilling operations, according to one or more embodiments shown and described herein.

Now referring to FIG. 1, process 100 depicts a method of monitoring solids content during drilling operations. According to FIG. 1, collecting real-time cuttings image data is performed in step 102. Following step 102, cuttings characteristic data based on the collected cuttings image data is determined in step 104. In step 108, real-time surface mud data is collected. In step 106, a multi-dimensional computational fluid dynamics model is converted into a one-dimensional continuous cuttings transport model. Following steps 104, 106, and 108, an integrated one-dimensional continuous cuttings transport model is computed in step 110, with outputs of steps 104 and 108 as inputs to step 110. Following step 110, outputs of the integrated one-dimensional continuous cuttings transport model are generated in step 112, with the outputs of steps 104 and 108 as inputs to step 112. Following step 112, real-time downhole cuttings information is determined based on the outputs of step 112 in step 114.

In one or more embodiments, in process 100 solids content may be measured during drilling operations. As described herein, "solids content" may refer to the concentration of suspended solid particles in a fluid at a point in space and time. Solids content may be the concentration of suspended drill cuttings in a drilling mud along a horizontal segmentation of a borehole.

As described herein, "borehole" may refer to a drilled hole extending from the surface of the Earth down to a subsurface formation, including the openhole or uncased portion. The borehole may form a pathway capable of permitting fluids to traverse between the surface and the subsurface formation. The borehole may include at least a portion of a fluid conduit that links the interior of the borehole to the surface. The fluid conduit connecting the interior of the borehole to the surface may be capable of permitting regulated fluid flow from the interior of the borehole to the surface and may permit access between equipment on the surface and the interior of the borehole.

As described herein, "real-time" may refer to a system in which input data may be processed within relatively short period of time so that it may be available almost immediately as feedback. For example, and in embodiments, real-time data may be processed within 1 millisecond, 100 milliseconds, 500 milliseconds, 1 second, 5 seconds, 10 seconds, 15 seconds, or any similar timeframe such as those formed by a range with any two disclosed time units as the endpoints. Real-time data may also refer to data that may be processed so that personnel may make decisions almost immediately regarding downhole cuttings transport.

Still referring to FIG. 1, and in one or more embodiments, in step 102 real-time cuttings image data may be collected. As described herein, "cuttings," also referred to as "drill cuttings" herein, may refer to material produced as a drill bit drills into earth. Cuttings may be pieces of solid earth material or geologic formations that are produced as a drill bit mills rock. As described herein, "image data" may refer to visual characteristics of cuttings captured through a digital imaging device. For example, a digital imaging device such as a camera may capture the visual characteristics of a cutting at a snapshot in time.

In one or more embodiments, the image data may be video data. As described herein, "video data" may refer to a series of visual characteristics captured through a digital imaging device over a period of time. A digital imaging device such as a video camera may capture the visual characteristics of a set of objects passing by a set reference point over a period of time. Video data may be collected by a digital imaging device like a sensor positioned at the surface outlet of the natural resource well. Two-dimensional high-definition color image recording from a sensor may scan the physical distance between a target surface and the sensor's reference position to collect video data. Three-dimensional vision techniques from a sensor may scan the physical distance between a target surface and the sensor's reference position.

In one or more embodiments, the real-time cuttings image data may be collected at the surface outlet of a natural resource well. As described herein, "surface outlet" may refer to the returns-end of a natural resource well. Muds may be circulated through the drill bit and back to surface along with suspended cuttings through the surface outlet.

In one or more embodiments, the image data may be collected at a shale shaker. As described herein, "shale shaker" may refer to a mechanical device that separates particles of different sizes by agitation such as vibration over one or more screens within a shale shaker basket. The screens may be belt-driven or the screens may not be belt-driven. The inlet of the shale shaker may be configured to receive the unseparated particles while an outlet of the shale shaker may be configured to dispose of unwanted separated particles. In embodiments, the inlet and outlet may be interposed by a shale shaker basket. A top screen may be of a greater mesh size than a screen immediately below. This may allow smaller particles to pass through one or more screens while larger particles may be retained on a screen and transported to the outlet.

In one or more embodiments, a shale shaker may be used to separate mud from cuttings so that the mud may be recirculated through the well. The inlet of the shale shaker may be configured to receive combined mud and cuttings. The outlet may be configured to dispose of separated cuttings. The mud may be separated from cuttings by vibration over one or more screens. The separated mud may fall to the bottom of the shale shaker basket where it may be recirculated into the natural resource well. The separated cuttings may be disposed of at the outlet of the shale shaker. In one or more embodiments, image data may be collected at a shale shaker by the placement of a digital imaging device such as a camera at a stationary, non-vibrating point in unobstructed view of the shale shaker. The camera may be pointed at the intake of the shale shaker and configured to capture digital images of the cuttings while the shale shaker separates the mud and cuttings.

Still referring to FIG. 1, and in one or more embodiments, in step 104 cuttings characteristic data may be determined based on the collected real-time cuttings image data. As described herein, "cuttings characteristics data" may refer to visually observable qualities of drill cuttings. For example, visually observable qualities may include size, volume, velocity, orientation, and area. The cuttings characteristic data may include cuttings size distribution, cuttings volume, cuttings velocity, cuttings orientation, cuttings area, or combinations thereof.

As described, the cuttings characteristic data may be cuttings size distribution. As described herein, "cuttings size distribution" may refer to a measure of amount of cuttings of a range of grain sizes observed in one or more sample sets. In one or more embodiments, the cuttings size distribution may be mapped as individual concentrations of cuttings on a grain size scale of 0.01 to 10 mm.

As described, the cuttings characteristic data may be cuttings volume. As described herein, "cuttings volume" may refer to a measure of the total volumetric amount of cuttings observed in a reference time period. In one or more embodiments, cuttings volume may be the volumetric total of cuttings, expressed in gallons, barrels, or cubic feet, entering the shale shaker in one minute.

As described, the cuttings characteristic data may be cuttings velocity. As described herein, "cuttings velocity" may refer to a measure of the rate at which one or more objects pass a reference point. In one or more embodiments, cuttings velocity may be expressed as the rate at which cuttings enter and exit the shale shaker. As described herein, "cuttings slip velocity" may refer to a velocity at which a fluid must flow to carry and overcome the settling tendency of a suspended solid due to that solid's density.

As described, the cuttings characteristic data may be cuttings orientation. As described herein, "cuttings orientation" may refer to the shape, including but not limited to angularity or roundness of objects observed within a reference area. In one or more embodiments, cuttings orientation may be used to describe the shape of drill cuttings observed at surface. It is contemplated that this may give an indication of whether drilled formations with certain recognizable grain shapes are being circulated out of the well.

As described, the cuttings characteristic data may be cuttings area. As described herein, "cuttings area" may refer to the cross-sectional area of an objects observed within a reference area. In one or more embodiments, cuttings area may be expressed as the average cross-sectional area of cuttings observed over a reference time period.

Still referring to FIG. 1 and step 104, in one or more embodiments, the cuttings size distribution, cuttings volume, cuttings velocity, cuttings orientation, cuttings area, or combinations thereof may be determined. Cuttings size distribution, cuttings volume, cuttings velocity, cuttings orientation, and cuttings area may be determined based on an image processing technique. As described herein, "image processing technique" may refer to an automated process that receives images captured by a digital imaging device and translates the image data into quantitative data. For example, the image processing technique may translate real-time cuttings image data into cuttings characteristics data. The image processing technique may store images captured by a digital imaging device in a computer-readable-medium. The images may then be transferred to one or more computer processors which may interpret the information and convert it to cuttings characteristics data.

Still referring to FIG. 1, in one or more embodiments, in step 108 real-time surface mud data may be collected. The real-time surface mud data may be collected at a surface inlet of the natural resources well. As described herein, "surface inlet" may refer to the injection-end of a natural resource well. In one or more embodiments, muds may be circulated from surface to an injection point on a drill string, through the interior of the drill string, and down to a drill bit. The process of collecting mud data may be typically referred to as "mud logging." The real-time surface mud data may be collected using surface instruments, laboratory tests, laboratory data, and performing by-hand calculations. By way of non-limiting example, real-time surface mud data from surface instruments may include data collected from surface sensors installed on different parts of surface equipment, such as the shale shaker.

In one or more embodiments, the real-time surface mud data may include inlet mud parameters, drilling operational parameters, well planning parameters, or combinations thereof. The inlet mud parameters include mud rheology, mud density, standpipe pressure, in-flow rate, pump stroke count, pump stroke rates, or combinations thereof.

As described, the real-time surface mud data may be mud rheology. As described herein, "rheology" may refer to a substance's response to stress as deformation. In one or more embodiments, mud rheology may include viscosity, yield point, gel strength, modulus of elasticity, Poisson's ratio, or combinations thereof.

As described, the real-time surface mud data may be standpipe pressure. As described herein, "standpipe pressure" may refer to the total pressure loss in a drilling system that occurs due to fluid friction. In one or more embodiments, standpipe pressure may be the sum of friction pressure losses in the annulus, drill string, bottom hole assembly, and across the drill bit. Standpipe pressure may be expressed in pounds per square inch.

As described, the real-time surface mud data may be in-flow rate. As described herein, "in-flow rate" may refer to the total volumetric flow rate at an inlet point. In one or more embodiments, in-flow rate may be the volumetric flow rate of drilling mud injected at surface through the drill string.

As described, the real-time surface mud data may be pump stroke count. As described herein, "pump stroke count" may refer to the total completed revolutions an engine piston makes in a given period of time. In one or more embodiments, pump stroke count may be the expression of the total revolutions a mud pump achieves multiplied by the number of mud pump cylinders in one minute of time.

As described, the real-time surface mud data may be pump stroke rate. As described herein, "pump stroke rate" may refer to the rate at which an engine piston will complete revolutions. In one or more embodiments, pump stroke rate may be the measure of the number of strokes a mud pump completes every minute.

Still referring to FIG. 1 and step 108, and in one or more embodiments, the drilling operational parameters may include drillpipe revolutions per time, rate of penetration, weight on bit, or combinations thereof. As described herein, "drill pipe revolutions per time" may refer to the rate at which the drill string rotates at a certain point in time during a drilling operation. Drill pipe revolutions per time may be expressed in circumferential rotations per minute. As described herein, "rate of penetration" may refer to the rate at which the drill bit and drill string achieves depth during a drilling operation. Rate of penetration may be expressed as feet over minutes. As described herein, "weight on bit" may refer to the force applied to the drilling surface of a wellbore during drilling operations. Weight on bit may be the sum of the weight of the drill string, buoyant forces by the mud, and hydraulic forces applied by the drilling platform.

In one or more embodiments, the well planning parameters may include borehole geometry, borehole survey data, drill bit parameters, or combinations thereof. As described herein, "borehole geometry" may refer to a schematic showing the different sections and sizes of the drilled borehole. Borehole geometry may be a scaled schematic showing the borehole from top-to-bottom, including casing and borehole sizes, depths, and diameters. As described herein, "borehole survey data" may refer to measurements obtained showing the geo-positional location of the borehole along the length of that borehole. Borehole survey data may include the measured latitude, longitude, and depth at points along the measured length of the borehole. As described herein, "drill bit parameters" may refer to the specifications or qualities of a drill bit. Drill bit parameters may include bit size, bit type, number of blades, number of jets, jet size, composition material, or combinations thereof.

Still referring to FIG. 1, and in one or more embodiments, in step 106 the multi-dimensional computational fluid dynamics model may be converted to the one-dimensional continuous cuttings transport model. Step 106 of FIG. 1 may be identical to process 200 of FIG. 2. As described herein, "multi-dimensional computational fluid dynamics model" may refer to a set of mass balance equations used to model multi-dimensional fluid problems and provide a multi-dimensional solution. The multi-dimensional computational fluid dynamics model may be two-dimensional or three-dimensional. As described herein, "two-dimensional" may refer to data or modeling in two dimensions. For example, in a wellbore, two dimensional data may refer to data in height and a single axial direction of the wellbore. As described herein, "three-dimensional" may refer to data or modeling in three dimensions. For example, in a wellbore, three dimensional data may refer to data in both the height and axial directions of the wellbore. As described herein, "one-dimensional" may refer to data or modeling in a single dimension. For example, in a wellbore, one dimensional data may refer to data in only the height direction of the wellbore irrespective of axial directions.

Still referring to FIG. 1, and in one or more embodiments, in step 110 the integrated one-dimensional continuous cuttings transport model may be computed from the one-dimensional continuous cuttings transport model generated by step 106. The inputs to step 110 may include the cuttings characteristic data of step 104 and the real-time surface mud data of step 108. Step 110 of FIG. 1 may be identical to process 300 of FIG. 3.

In one or more embodiments, the integrated one-dimensional continuous cuttings transport model may be computed by a data assimilation method. As described herein, "data assimilation method" may refer to a process of modeling chaotic dynamical systems that are too difficult to predict using simple extrapolation. In these systems, small changes in initial conditions may lead to large changes in prediction accuracy. The purpose of data assimilation is then to pair simulated outputs of the model with actual observable measurements, reducing prediction error over time as the model better approaches the actual results.

In one or more embodiments of the data assimilation method, a first output or prediction of a model may be taken, usually referred to as the forecast. The difference between the forecast and an observed measurement may then be referred to as a departure. This departure may then be adjusted by a weighting factor to control the degree of change the model may experience. The weighting factor may be adjusted based on a perceived error thought to be present in the model parameters. This weighted departure may then be fed back into the model which may adjust to create a new forecast. This process may be repeated as many times as necessary to reduce prediction error in further iteration outputs of the model.

Still referring to FIG. 1, and in one or more embodiments, in step 112 outputs of the integrated one-dimensional continuous cuttings transport model computed by step 110 may be generated. The outputs to the integrated one-dimensional continuous cuttings transport model may be generated by inputting the outputs of step 104 and step 108 and running the one-dimensional continuous cuttings transport model.

Still referring to FIG. 1, and in one or more embodiments, in step 114 real-time downhole cuttings information may be determined from the outputs of step 112. As described herein, "real-time one-dimensional downhole cuttings information" may be to the outputs of the integrated one-dimensional continuous cuttings transport model. In one or more embodiments, real-time one-dimensional downhole cuttings information may be a cuttings concentration at a given measured length in a borehole.

Figure 2:
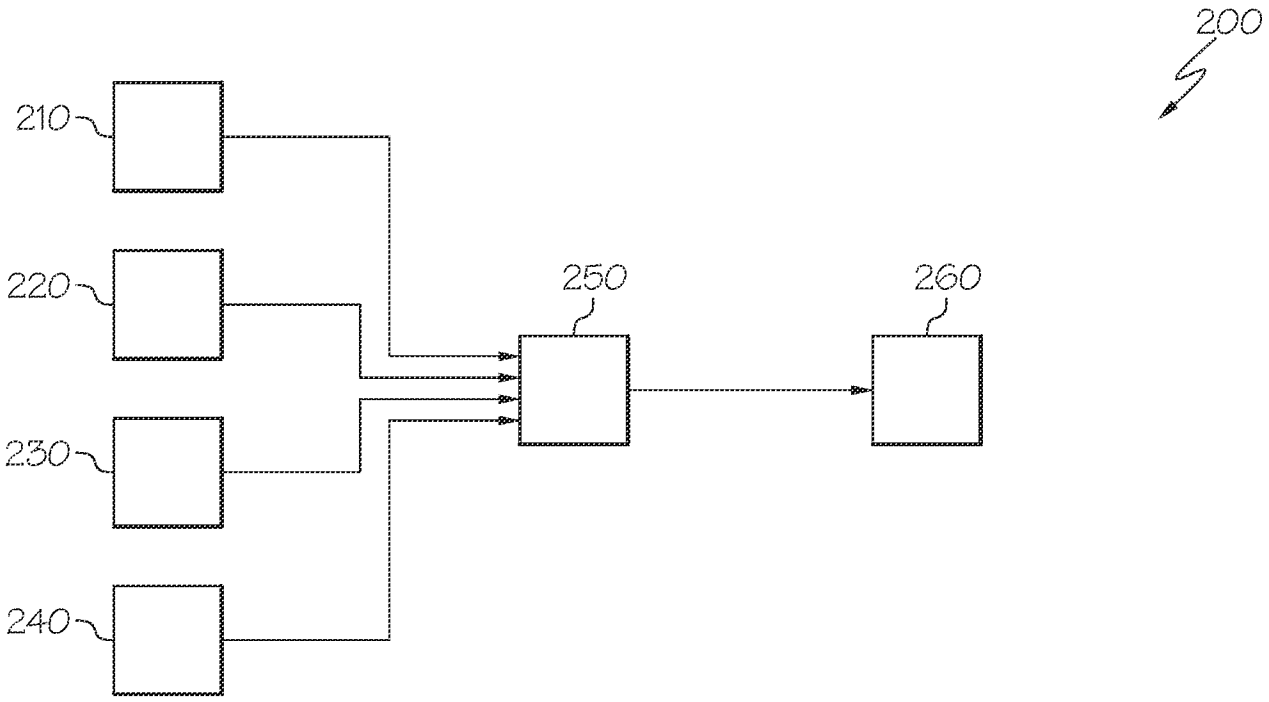
FIG. 2 depicts a process of a method of converting a multi-dimensional computational fluid dynamics model into an one-dimensional continuous cuttings transport model, according to one or more embodiments shown and described herein.

Now referring to FIG. 2, a process 200 is depicted of the method of converting the multi-dimensional computational fluid dynamics model to the one-dimensional continuous cuttings transport model. According to FIG. 2, and in embodiments, a multi-dimensional computation fluid dynamics model may be chosen in step 210. In step 220, a dual-phase modeling method may be chosen. In step 230, lab flow loop measurements may be collected. In step 240, field experiment data may be collected. Following steps 210, 220, 230, and 240, the multi-dimensional computational fluid dynamics model may be created in step 250. In step 250, the outputs of step 210 and 220 may be inputted into the multi-dimensional computational fluid dynamics model as model parameters. Also in step 250, the outputs of steps 230 and 240 may be inputted as model boundary conditions. Following step 250, the multi-dimensional computational fluid dynamics model is reduced in step 260.

As described, step 106 may be identical to process 200. In one or more embodiments, the multi-dimensional computational fluid mechanics model may be converted into a one-dimensional continuous cuttings transport model. The multi-dimensional computational fluid dynamics model may be converted by choosing a type of modeling method, choosing a dual-phase modeling method, determining lab flow loop measurements, collecting field experiment data, inputting flow loop measurements, inputting field experiment data, and reducing the model by section integration.

In step 210, and in one or more embodiments, a multi-dimensional computational fluid dynamics model type may be chosen. The multi-dimensional computational fluid dynamics model type may be chosen from one of: direct numerical simulations, large eddy simulations, and Reynolds averaged Navier-Stokes simulations. As described herein, "direct numerical simulation" may refer to a numerical simulation in computational fluid dynamics in which the Navier-Stokes equations are numerically solved. This may be differentiated from analytical techniques, wherein Navier-Stokes equations are approximated by analytical formulas. As described herein, "large eddy simulation" may refer to a mathematical model for turbulence used in computational fluid dynamics. As described herein, "Reynolds averaged Navier-Stokes simulation" may refer to an approximation of a Navier-Stokes equation using time averaging for fluid flow. Reynold averaged Navier-Stokes simulations may be primarily used to describe turbulent flow.

In one or more embodiments, multi-dimensional computational fluid dynamics models may become complex and more time-consuming to calculate when second particle phases are involved, such as dispersed solid particles suspended in a continuous fluid phase. The dispersed solid particles phase may be modeled using a dual-phase modeling method.

Still referring to FIG. 2, and in one or more embodiments, in step 220 the dual-phase modeling method may be chosen. Dual-phase modeling method may be chosen from an Eulerian-Eulerian or an Eulerian-Lagrange method. As described herein, the "Eulerian-Eulerian" method may refer to a dual-phase modeling method where both the dispersed particle phase and continuous fluid phase are solved using the governing equations. As described herein, the "Eulerian-Lagrange" method may refer to a dual-phase modeling method where the Eulerian framework may be used for the continuous phase and the dispersed phase trajectories may be solved using the Lagrangian framework. In one or more embodiments, the dispersed solid particle phase may be cuttings and the continuous fluid phase may be mud.

Still referring to FIG. 2, and in one or more embodiments, in step 230 lab flow loop measurements may be collected. As described herein, a "lab flow loop" may refer to a set of laboratory instruments designed to investigate fluid flow in mediums resembling real world systems to estimate multiphase flow parameters, such as friction. By way of non-limiting example, one lab flow loop system may include a closed-circulation mud flow loop where the mud flow is created and controlled by a pump. The lab flow loop system may include drilling mud and drill cuttings. The mud flow part of the loop is represented by a transparent pipe in which the flow of the mud with suspended cuttings is observed. The following measurements may then be measured in the lab flow loop system: real-time inlet and outlet pressure measurements, real-time inlet and outlet temperature measurements, flow rates of mud (measured through a flow meter), and video and photo recordings of mud and cuttings behavior. In one or more embodiments, the lab flow loop measurements may include the immediately previous measurements. Also in the lab flow loop system, flow rates of mud may be changed by altering an inlet valve, a pump control, or both. Also in the lab flow loop system, video and photo recordings may be used to observe and record the dynamics of cuttings accumulation, cuttings transport, or both. Also in the lab flow loop system, cuttings size and shape may be changed by adding or removing cuttings or other material with known qualities to or from the lab flow loop system.

As described herein, cuttings accumulation may refer to a relative density settling tendency where some cuttings drop from the suspending fluid, resulting in cuttings falling down and gathering together at a location typically referred to as a "cuttings bed." Cuttings may drop from the suspending fluid when the suspending fluid's velocity is lower than a cuttings slip velocity associated with the suspended cuttings.

Still referring to FIG. 2, and in one or more embodiments, the variation of cuttings size and shape may impact cuttings accumulation, cuttings transport, or both in the lab flow loop system, which may be studied under different flow regimes. For example, the cuttings accumulation, cuttings transport, or both may be studied under laminar flow, turbulent flow, or transitional flow. Studying cuttings accumulation, cuttings transport, or both under different flow regimes in the lab flow loop system may provide insight into how different flow parameters affect cuttings behavior in mud flow and may model drilling operations in the natural resource well.

Still referring to FIG. 2, and in one or more embodiments, in step 240 field experiment data may be collected. As described herein, "field experiment data" may refer to data generated on the site of drilling operations through tests. In one or more embodiments, field experiment data may be any of the cuttings characteristic data, the surface mud data, or both, as previously described herein.

Still referring to FIG. 2, in one or more embodiments, in step 250 the multi-dimensional computation fluid dynamics model may be created. The multi-dimensional computation fluid dynamics model may be created by inputting the chosen model type of step 210, inputting the chosen dual-phase modeling method of step 220, inputting the collected lab flow loop measurements of step 230 as a boundary condition, and inputting the collected field experiment data of step 240 as a boundary condition.

In one or more embodiments, lab flow loop measurements may be inputted as a boundary condition in the multi-dimensional computational fluid dynamics model. Field experiment data may be inputted as a boundary condition in the multi-dimensional computational fluid dynamics model. As described herein, a "boundary condition" may refer to a set of initial constraints as to model parameters or inputs to simplify the calculation of the model. For example, friction values obtained from a lab flow loop measurement may be inserted as a boundary condition in a multi-dimensional computational fluid dynamics model to increase the speed at which the multi-dimensional computational fluid dynamics model operates.

Still referring to FIG. 2, and in one or more embodiments, in step 260 the multi-dimensional computational fluid dynamics model may be reduced. The multi-dimensional computational fluid dynamics model may be reduced by section integration of the model of step 250. As used herein, "section integration" may refer to a process by which a large scale multiple dimension model may be reduced by the simplification or reduction of the equations governing the model. For example, section integration may be undertaken to reduce the complexity of model equations to reduce time and costs in computation. In one or more embodiments, the multi-dimensional computational fluid dynamics model may be reduced by section integration of the multi-dimensional computational fluid dynamic model after equation simplification by entry of the boundary conditions. Section integration of the model of step 250 may produce the one-dimensional continuous cuttings transport model.

Figure 3:
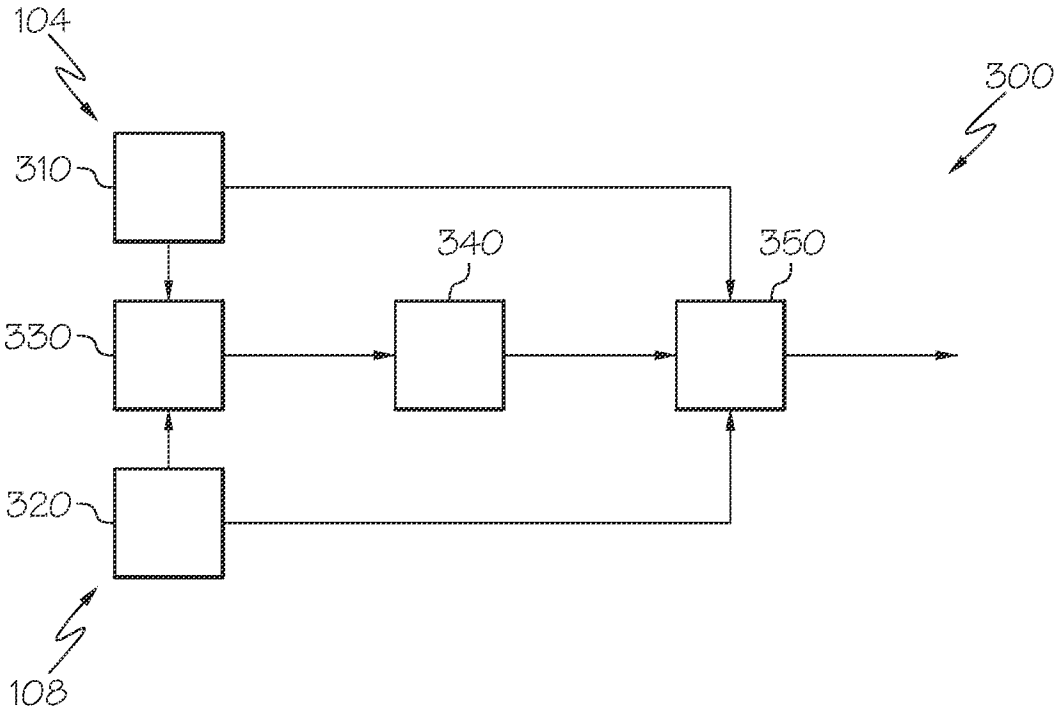
FIG. 3 depicts a process of a method of computing an integrated one-dimensional continuous cuttings transport model from a one-dimensional continuous cuttings transport model, according to one or more embodiments shown and described herein.

Now referring to FIG. 3, a process 300 is depicted of the method of computing the integrated one-dimensional continuous cuttings transport model from the one-dimensional continuous cuttings transport model. According to FIG. 3, cuttings characteristic data may be collected in step 310. In step 320, real-time surface mud data may be collected. Following steps 310 and 320, outputs for the one-dimensional continuous cuttings transport model may be generated in step 330, with the outputs of steps 310 and 320 as inputs to the one-dimensional continuous cuttings transport model.

Following step 330, the integrated one-dimensional continuous cuttings transport model may be determined in step 340. Following step 340, the outputs of the integrated one-dimensional continuous cuttings transport model may be determined in step 350, with the outputs of steps 310 and 320 as inputs to the integrated one-dimensional continuous cuttings transport model.

As described, step 110 may be identical to process 300. In one or more embodiments, Step 300 may be the same step as step 110. The integrated one-dimensional continuous cuttings transport model may be computed from the one-dimensional continuous cuttings transport model. The integrated one-dimensional continuous cuttings transport model may also be computed by inputting cuttings characteristic data and real-time mud data into the one-dimensional continuous cuttings transport model, generating outputs for the one-dimensional continuous cuttings transport model, integrating the one-dimensional continuous cuttings transport model, inputting cuttings characteristic data and real-time mud data into the integrated one-dimensional continuous cuttings transport model, and generating outputs for the integrated one-dimensional continuous cuttings transport model.

Still referring to FIG. 3, and in one or more embodiments, in step 310 cuttings characteristic data may be collected. Step 310 may be the same step as step 104 of FIG. 1. In step 320, real-time surface mud data may be collected. Step 320 may be the same step as step 108 of FIG. 1. In step 330, outputs of the one-dimensional continuous cuttings transport model may be generated. The inputs to the one-dimensional continuous cuttings transport model may include the cuttings characteristic data, the real-time surface mud data, or both. Outputs of the one-dimensional continuous cuttings transport model may be generated by inputting the cuttings characteristic data generated by step 310 and real-time surface mud data generated by step 320 into the model and running the model.

Still referring to FIG. 3, and in one or more embodiments, in step 340 the integrated one-dimensional continuous cuttings transport model may be determined. The integrated one-dimensional continuous cuttings transport model may be determined using the data assimilation method on the outputs generated by step 330 and the one-dimensional continuous cuttings transport model. In one or more embodiments, the data assimilation method may be a filtering algorithm. The filtering algorithm may be a particle-filtering technique, a Bayesian technique, a Kalman-filtering technique, or an Ensemble-Kalman filtering technique.

As described, the data assimilation method may be a filtering algorithm. As described herein, and in embodiments, "filtering algorithm" may refer to a particular form of data assimilation implementing filtering, where the state of the system, through forecasts and weighted departures, may be constantly updated every time new input data becomes available. A filtering algorithm may be applied to the one-dimensional continuous cuttings transport model. The filtering algorithm may use cuttings characteristic data, real-time surface mud data, and model outputs to filter the one-dimensional continuous cuttings transport model in real-time and obtain inferences of cuttings distribution along the wellbore.

As described, and in embodiments, the filtering algorithm may be a particle-filtering technique, a Bayesian technique, a Kalman-filtering technique, or an Ensemble-Kalman filtering technique. As described herein, "particle-filtering technique" may refer to a sequential Monte Carlo based technique, which models the probability density function using a set of discrete points. As described herein, "Bayesian technique" may refer to a general probabilistic approach for estimating an unknown probability density function recursively over time using incoming measurements and a mathematical process model. As described herein, "Kalman filtering technique" may be a simplification of the Bayesian estimate for a linear model which explicitly takes account of the dynamic propagation of errors in the model, providing a flow-dependent error covariance. As described herein, "Ensemble-Kalman filtering technique" may refer to a Monte Carlo approximation of a Kalman filter.

Still referring to FIG. 3, and in one or more embodiments, in step 350 outputs for the integrated one-dimensional continuous cuttings transport model may be generated. The inputs to the integrated one-dimensional continuous cuttings transport model may include the cuttings characteristic data and the real-time surface mud data. Outputs for the integrated one-dimensional continuous cuttings transport model may be generated by inputting the cuttings characteristic data generated by step 310 and the real-time surface mud data generated by step 320 into the integrated one-dimensional continuous cuttings transport model and running the integrated one-dimensional continuous cuttings transport model. The outputs of the integrated one-dimensional continuous cuttings transport model may be the inputs to step 114 of FIG. 1 of determining real-time downhole cuttings information.

The present application discloses several technical aspects. One aspect is a method for monitoring solids content during drilling operations, the method comprising: collecting real-time cuttings image data at a surface outlet of a natural resource well; determining cuttings characteristics data based on the real-time cuttings image data, wherein the cuttings characteristics data comprises cuttings size distribution, cuttings volume, cuttings velocity, cuttings orientation, cuttings area, or combinations thereof; collecting real-time surface mud data, wherein the real-time surface mud data comprises inlet mud parameters, drilling operational parameters, well planning parameters, or combinations thereof; and determining real-time, one-dimensional downhole cuttings information based on a multi-dimensional computational fluid dynamics model, wherein the determining of the real-time, one-dimensional downhole cuttings information comprises: converting the multi-dimensional computational fluid dynamics model into a one-dimensional continuous cuttings transport model; and computing an integrated one-dimensional continuous cuttings transport model, wherein inputs to the integrated one-dimensional continuous cuttings transport model comprise: the cuttings characteristics data; and the real-time surface mud data.

Another aspect includes any previous aspect, wherein the image data is video data.

Another aspect includes any previous aspect, wherein the image data is collected at a shale shaker.

Another aspect includes any previous aspect, wherein the cuttings size distribution, cuttings volume, cuttings velocity, cuttings orientation, and cuttings area are determined based on an image processing technique of the real-time cuttings image data.

Another aspect includes any previous aspect, wherein the inlet mud parameters comprise mud rheology, mud density, standpipe pressure, in-flow rate, pump stroke count, pump stroke rates, or combinations thereof.

Another aspect includes any previous aspect, wherein the drilling operational parameters comprise drill pipe revolutions per time, rate of penetration, weight on bit, or combinations thereof.

Another aspect includes any previous aspect, wherein the well planning parameters comprise borehole geometry, borehole survey data, drill bit parameters, or combinations thereof.

Another aspect includes any previous aspect, wherein the multi-dimensional computational fluid dynamics model is two-dimensional or three-dimensional.

Another aspect includes any previous aspect, wherein converting the multi-dimensional computational fluid dynamics model into the one-dimensional continuous cuttings transport model comprises: choosing a multi-dimensional computational fluid dynamics model type from the group of Direct Numerical Simulation, Large Eddy Simulation, and Reynolds Averaged Navier-Stokes Simulation; choosing a dual-phase modeling method from an Eulerian-Eulerian or Eulerian-Lagrange method; determining lab flow loop measurements; inputting the lab flow loop measurements as a boundary condition in the multi-dimensional computational fluid dynamics model; inputting the field experiment data as a boundary condition in the multi-dimensional computational fluid dynamics model; and reducing the multi-dimensional computational fluid dynamics model to the one-dimensional continuous cuttings transport model using section integration.

Another aspect includes any previous aspect, wherein computing the integrated one-dimensional continuous cuttings transport model comprises: inputting cuttings characteristic data into the one-dimensional continuous cuttings transport model; inputting real-time surface mud data into the one-dimensional continuous cuttings transport model; computing outputs of the one-dimensional continuous cuttings transport model; determining the integrated one-dimensional continuous cuttings transport model using a data assimilation method on the one-dimensional continuous cuttings transport model; and generating outputs for the integrated one-dimensional continuous cuttings transport model.

Another aspect includes any previous aspect, wherein the data assimilation method is a filtering algorithm.

Another aspect includes any previous aspect, wherein the filtering algorithm is a particle filtering technique.

Another aspect includes any previous aspect, wherein the filtering algorithm is a Bayesian technique.

Another aspect includes any previous aspect, wherein the filtering algorithm is a Kalman-filtering technique.

Another aspect includes any previous aspect, wherein the filtering algorithm is an Ensemble-Kalman filtering technique.

Having described the subject matter of the present disclosure in detail and by reference to specific embodiments, it is noted that the various details described in this disclosure should not be taken to imply that these details relate to elements that are essential components of the various embodiments described in this disclosure, even in cases where a particular element is illustrated in each of the drawings that accompany the present description. Rather, the appended claims should be taken as the sole representation of the breadth of the present disclosure and the corresponding scope of the various embodiments described in this disclosure. Further, it should be apparent to those skilled in the art that various modifications and variations can be made to the described embodiments without departing from the spirit and scope of the claimed subject matter. Thus it is intended that the specification cover the modifications and variations of the various described embodiments provided such modification and variations come within the scope of the appended claims and their equivalents.

It is noted that one or more of the following claims utilize the term "wherein" as a transitional phrase. For the purposes of defining the present invention, it is noted that this term is introduced in the claims as an open-ended transitional phrase that is used to introduce a recitation of a series of characteristics of the structure and should be interpreted in like manner as the more commonly used open-ended preamble term "comprising."

The invention claimed is:

1. A method for monitoring solids content and modifying mud parameters, drilling operational parameters, or both during drilling operations, the method comprising:

collecting real-time cuttings image data at a surface outlet of a natural resource well;

determining cuttings characteristics data based on the real-time cuttings image data, wherein the cuttings characteristics data comprises cuttings size distribution, cuttings volume, cuttings velocity, cuttings orientation, cuttings area, or combinations thereof;

collecting real-time surface mud data, wherein the real-time surface mud data comprises inlet mud parameters, drilling operational parameters, well planning parameters, or combinations thereof;

determining real-time, one-dimensional downhole cuttings information based on a multi-dimensional computational fluid dynamics model, wherein the determining of the real-time, one-dimensional downhole cuttings information comprises converting the multi-dimensional computational fluid dynamics model into a one-dimensional continuous cuttings transport model, and computing an integrated one-dimensional continuous cuttings transport model from the one-dimensional continuous cuttings transport model, wherein inputs to the integrated one-dimensional continuous cuttings transport model comprise the cuttings characteristics data and the real-time surface mud data; and modifying the mud parameters, the drilling operational parameters, or both in response to the integrated one-dimensional continuous cuttings transport model, wherein:

modifying the drilling operational parameters comprises increasing or decreasing drill pipe revolutions per time, increasing or decreasing a weight on bit, increasing or decreasing a rate of penetration, or combinations thereof, and modifying the mud parameters comprises increasing or decreasing a viscosity of the drilling fluid, thereby altering the mud rheology, increasing or decreasing a mud density, or both.

2. The method of claim 1, wherein the real-time cuttings image data is video data.

3. The method of claim 1, wherein the real-time cuttings image data is collected at a shale shaker.

4. The method of claim 1, wherein the cuttings size distribution, cuttings volume, cuttings velocity, cuttings orientation, and cuttings area are determined based on an image processing technique of the real-time cuttings image data.

5. The method of claim 1, wherein the inlet mud parameters comprise mud rheology, mud density, standpipe pressure, in-flow rate, pump stroke count, pump stroke rates, or combinations thereof.

6. The method of claim 1, wherein the drilling operational parameters comprise drill pipe revolutions per time, rate of penetration, weight on bit, or combinations thereof.

7. The method of claim 1, wherein the well planning parameters comprise borehole geometry, borehole survey data, drill bit parameters, or combinations thereof.

8. The method of claim 1, wherein the multi-dimensional computational fluid dynamics model is two-dimensional or three-dimensional.

9. The method of claim 1, wherein converting the multi-dimensional computational fluid dynamics model into the one-dimensional continuous cuttings transport model comprises:

choosing a multi-dimensional computational fluid dynamics model type from the group of Direct Numerical Simulation, Large Eddy Simulation, and Reynolds Averaged Navier-Stokes Simulation;

choosing a dual-phase modeling method from an Eulerian-Eulerian or Eulerian-Lagrange method;

determining lab flow loop measurements;

inputting the lab flow loop measurements as a boundary condition in the multi-dimensional computational fluid dynamics model;

inputting the field experiment data as a boundary condition in the multi-dimensional computational fluid dynamics model; and reducing the multi-dimensional computational fluid dynamics model to the one-dimensional continuous cuttings transport model using section integration.

10. The method of claim 1, wherein computing the integrated one-dimensional continuous cuttings transport model comprises:

inputting cuttings characteristic data into the one-dimensional continuous cuttings transport model;

inputting real-time surface mud data into the one-dimensional continuous cuttings transport model;

computing outputs of the one-dimensional continuous cuttings transport model;

determining the integrated one-dimensional continuous cuttings transport model using a data assimilation method on the one-dimensional continuous cuttings transport model; and generating outputs for the integrated one-dimensional continuous cuttings transport model.

11. The method of claim 10, wherein the data assimilation method is a filtering algorithm.

12. The method of claim 11, wherein the filtering algorithm is a particle filtering technique.

13. The method of claim 11, wherein the filtering algorithm is a Bayesian technique.

14. The method of claim 11, wherein the filtering algorithm is a Kalman-filtering technique.

15. The method of claim 11, wherein the filtering algorithm is an Ensemble-Kalman filtering technique.

16. A method for monitoring solids content and modifying mud parameters, drilling operational parameters, or both during drilling operations, the method comprising:

collecting real-time cuttings image data at a surface outlet of a natural resource well;

determining cuttings characteristics data based on the real-time cuttings image data using an image processing technique of the real-time cuttings image data, wherein the cuttings characteristics data comprises cuttings size distribution, cuttings volume, cuttings velocity, cuttings orientation, cuttings area, or combinations thereof;

collecting real-time surface mud data, wherein the real-time surface mud data comprises inlet mud parameters, drilling operational parameters, well planning parameters, or combinations thereof;

determining real-time, one-dimensional downhole cuttings information based on a multi-dimensional computational fluid dynamics model by converting the multi-dimensional computational fluid dynamics model into a one-dimensional continuous cuttings transport model, and computing an integrated one-dimensional continuous cuttings transport model, wherein inputs to the integrated one-dimensional continuous cuttings transport model comprise the cuttings characteristics data and the real-time surface mud data, the conversion comprises choosing a multi-dimensional computational fluid dynamics model type from the group of Direct Numerical Simulation, Large Eddy Simulation, and Reynolds Averaged Navier-Stokes Simulation, choosing a dual-phase modeling method from an Eulerian-Eulerian or Eulerian-Lagrange method, determining lab flow loop measurements, inputting the lab flow loop measurements as a boundary condition in the multi-dimensional computational fluid dynamics model, inputting the field experiment data as a boundary condition in the multi-dimensional computational fluid dynamics model, and reducing the multi-dimensional computational fluid dynamics model to the one-dimensional continuous cuttings transport model using section integration, and the integrated one-dimensional continuous cuttings transport model is computed by inputting cuttings characteristic data into the one-dimensional continuous cuttings transport model, inputting real-time surface mud data into the one-dimensional continuous cuttings transport model, computing outputs of the one-dimensional continuous cuttings transport model, determining the integrated one-dimensional continuous cuttings transport model using a data assimilation method on the one-dimensional continuous cuttings transport model, and generating outputs for the integrated one-dimensional continuous cuttings transport model; and modifying the mud parameters, the drilling operational parameters, or both in response to the integrated one-dimensional continuous cuttings transport model, wherein:

modifying the drilling operational parameters comprises increasing or decreasing drill pipe revolutions per time, increasing or decreasing a weight on bit, increasing or decreasing a rate of penetration, or combinations thereof, and modifying the mud parameters comprises increasing or decreasing a viscosity of the drilling fluid, thereby altering the mud rheology, increasing or decreasing a mud density, or both.

* * * * *